US009738418B2

(12) United States Patent
Tsai

(10) Patent No.: US 9,738,418 B2
(45) Date of Patent: Aug. 22, 2017

(54) STORAGE COMBINATION BASKET ASSEMBLY

(71) Applicant: Dongguan Master United Plastic & Hardware Products Co., Ltd., Dongguan, Guandong Province (CN)

(72) Inventor: Tsung-Yu Tsai, Changhua (TW)

(73) Assignee: Dongguan Master United Plastic & Hardware Products Co., Ltd., Dongguan, Guandong Province (CN)

( * ) Notice: Subject to any disclaimer, the term of this patent is extended or adjusted under 35 U.S.C. 154(b) by 33 days.

(21) Appl. No.: 14/849,195

(22) Filed: Sep. 9, 2015

(65) Prior Publication Data

US 2017/0066550 A1 Mar. 9, 2017

(51) Int. Cl.
*B65D 25/22* (2006.01)
*B65D 6/08* (2006.01)

(52) U.S. Cl.
CPC ..... *B65D 25/22* (2013.01); *B65D 7/20* (2013.01)

(58) Field of Classification Search
CPC ..... A47F 5/01; A47F 5/083; A47F 5/0838; A47F 5/13; A47K 3/281; A47K 5/04
USPC .... 211/13.1, 85.31, 88.01, 103, 106–106.01, 211/113, 119, 119.009, 133.5, 153, 175, 211/181.1, 187, 207; 220/23.4, 475, 482, 220/485; 206/493; 248/222.51, 302–303, 248/311.2; D6/525, 566, 570
See application file for complete search history.

(56) References Cited

U.S. PATENT DOCUMENTS 3,295,471 A * 1/1967 Cook ..... A47F 5/13 108/163
4,106,736 A * 8/1978 Becker, III ..... A47F 5/01 211/103
5,460,279 A * 10/1995 Emery ..... A47B 55/02 211/106
5,588,543 A * 12/1996 Finger ..... A47F 5/083 211/106
D387,595 S * 12/1997 Whang ..... D6/525
D446,670 S * 8/2001 Emery ..... D6/525
D473,411 S * 4/2003 Walker ..... D6/525
8,083,079 B2 * 12/2011 Rosen ..... D06F 79/02 211/106
8,186,521 B2 * 5/2012 Yu ..... A47B 55/02 211/106
8,807,353 B2 8/2014 Barkdoll et al.
(Continued)

*Primary Examiner* — Chun Cheung
*Assistant Examiner* — Brijesh V. Patel
(74) *Attorney, Agent, or Firm* — Muncy, Geissler, Olds & Lowe, P.C.

(57) ABSTRACT

A storage combination basket assembly includes one or multiple storage devices each including a base, a peripheral wall upwardly extended from the base and a positioning member connected to the peripheral wall with two opposite ends thereof respectively spaced from the peripheral wall by a gap, a support frame including first and second body frame rod segments arranged in parallel and respectively disposed in the gaps between the two opposite ends of the positioning member and the peripheral wall, and one or multiple stoppers connected to the first and second body frame rod segments of the support frame for supporting the one or multiple storage devices, each having two stop blocks disposed at two opposite ends thereof and respectively hooked in the peripheral wall of one respective storage device.

5 Claims, 9 Drawing Sheets

(56) References Cited

U.S. PATENT DOCUMENTS

| | | | | |
|---|---|---|---|---|
| 2004/0188369 | A1* | 9/2004 | Yu | A47K 5/04 211/106 |
| 2014/0124598 | A1* | 5/2014 | Vaccaro | E03C 1/06 239/289 |

* cited by examiner

STORAGE COMBINATION BASKET ASSEMBLY

BACKGROUND OF THE INVENTION

1. Field of the Invention

The present invention relates to a wall mount storage device technology and more particularly, to a storage combination basket assembly.

2. Description of the Related Art

Either at home or in business place or office, various storage baskets are needed so that users can store different things. Optimal storage racks allow user to clearly see storage items from the front side or top side.

Storage baskets can be divided into fixed type and combination type. Fixed type storage baskets require a large packaging space and are not conducive to delivery. U.S. Pat. No. 8,807,353 discloses a bin that may universally mount to either of cross wires or cross bars in a retail merchandising environment. The bin has hooks and retainers projecting from the back wall of the receptacle to provide for the universal mount structure. However, hanging hooks on cross wires or cross bars cannot hold the bin steadily in place, and the bin can easily be forced to move front-back or left-right.

SUMMARY OF THE INVENTION

The present invention has been accomplished under the circumstances in view. It is the main object of the present invention to provide a storage combination basket assembly, which is easy to assemble and has high stability.

To achieve this and other objects of the present invention, a storage combination basket assembly comprises a storage device, a support frame and a stopper. The storage device comprises a base, a peripheral wall and a positioning member. The peripheral wall extends upwards from the base. The positioning member is connected to the peripheral wall. The positioning member has two opposite ends thereof respectively spaced from the peripheral wall by a gap. The support frame comprises a first body frame rod segment and a second body frame rod segment arranged in parallel. The stopper is connected to the first and second body frame rod segments of the support frame, each comprising two stop blocks. Further, the stopper is adapted for supporting the storage device. Further, the first and second body frame rod segments of the support frame being respectively disposed in the gaps between the two opposite ends of the positioning member and the peripheral wall. Further, the two stop blocks of each stopper are respectively hooked in the peripheral wall of the storage device.

Thus, after installation of the storage device in the support frame and the stopper, the positioning member of the storage device is engaged between the first and second body frame rod segments of the support frame, the stop blocks of the stopper are hooked in the peripheral wall of the storage device to hold the respective storage device in place, prohibiting the storage device from front-back and left-right displacement.

Other advantages and features of the present invention will be fully understood by reference to the following specification in conjunction with the accompanying drawings, in which like reference signs denote like components of structure.

DETAILED DESCRIPTION OF THE INVENTION

The present invention will now be fully understood by reference to the following specification. However, it is to be understood that the sizes and appearances of the components illustrated in the accompanying drawings are simply for the purpose of illustration only, not intended to limit the scope of the invention.

Figure 1:
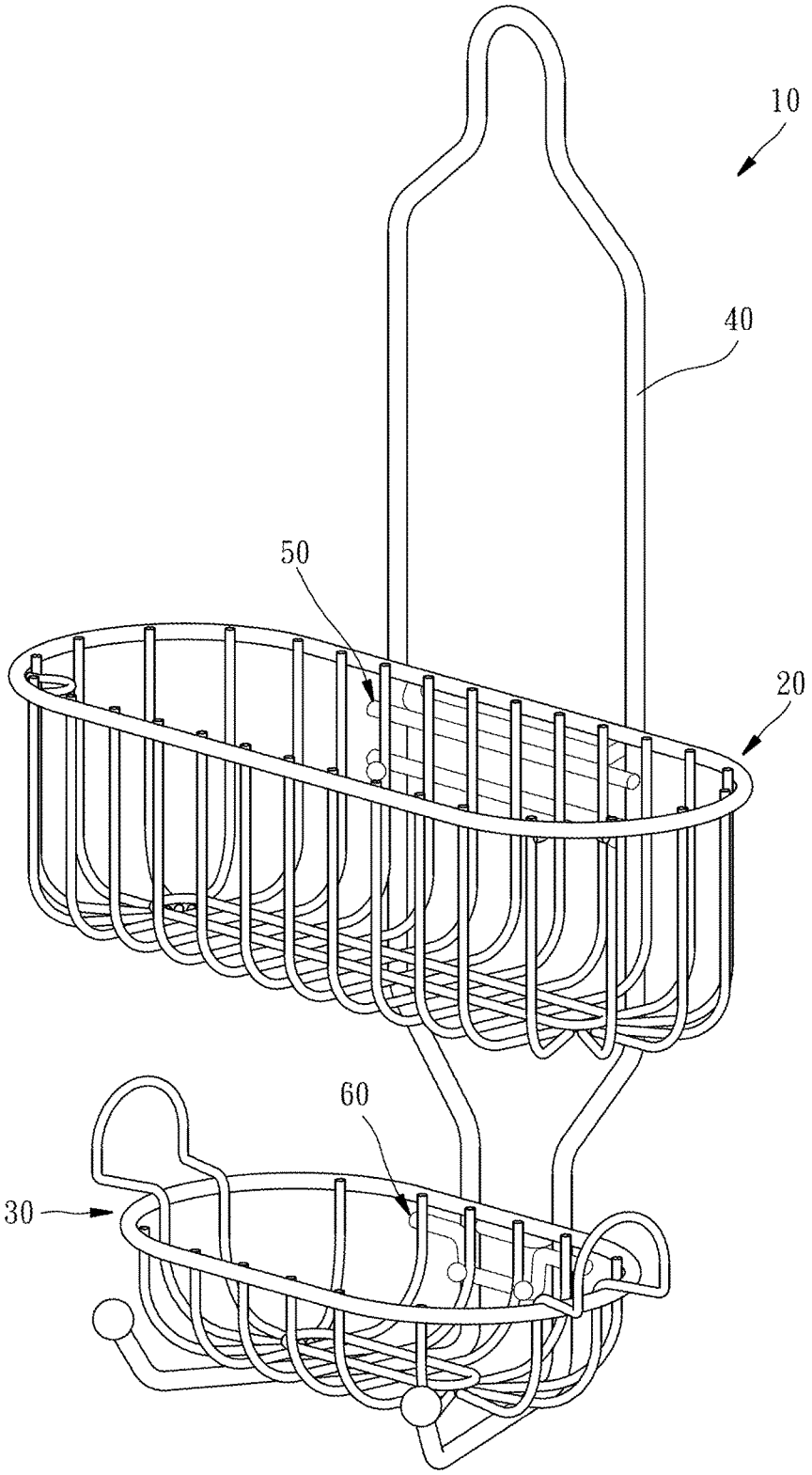
FIG. 1 is an oblique top elevational view of a storage combination basket assembly in accordance with the present invention.

Referring to FIG. 1, a storage combination basket assembly 10 in accordance with the present invention is shown. The storage combination basket assembly 10 comprises a first storage device 20, a second storage device 30, a support frame 40, a first stopper 50, and a second stopper 60. The first storage device 20 is mounted at the support frame 40 and the first stopper 50. The second storage device 30 is mounted at the support frame 40 and the second stopper 60.

The first and second storage devices 20,30 can be bins or trays, having substantially a similar structure.

Figure 2:
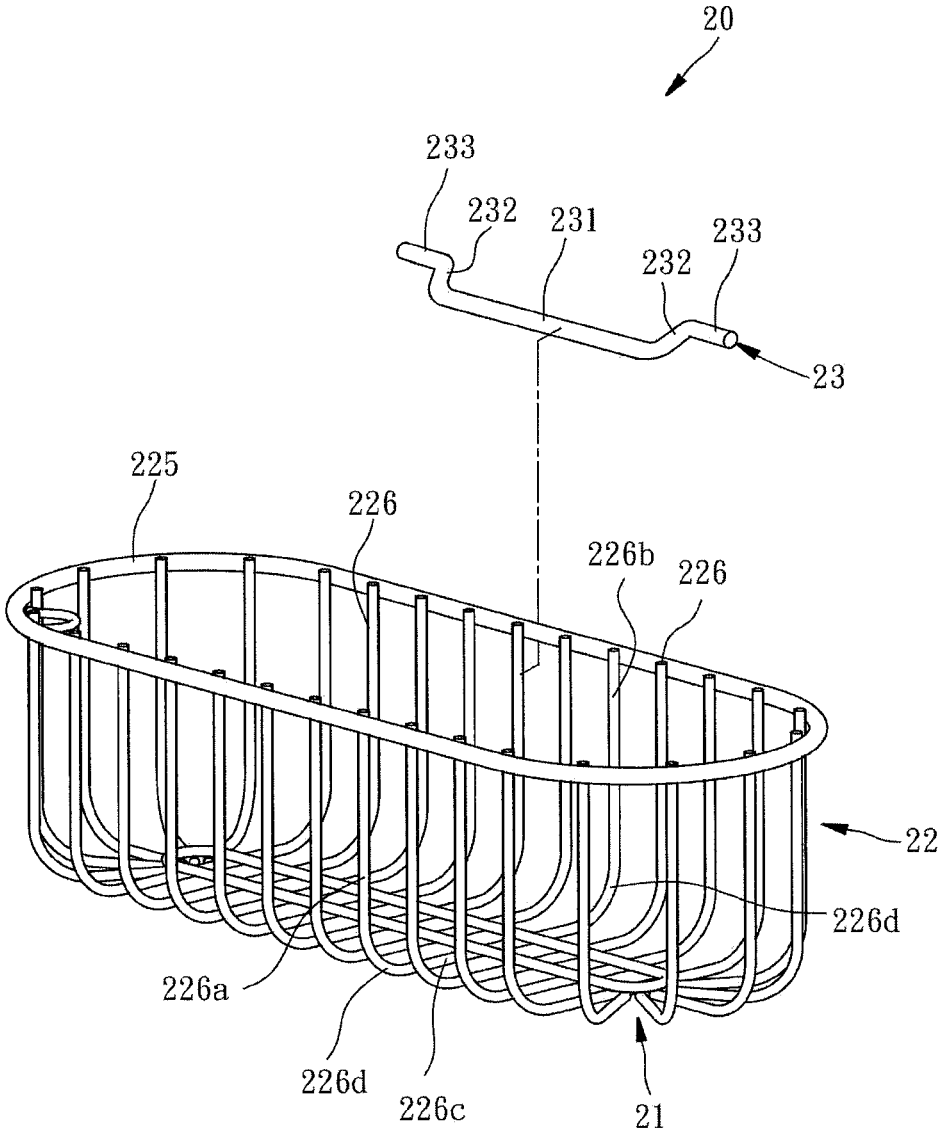
FIG. 2 is an elevational view of the first storage device of the storage combination basket assembly shown in FIG. 1.

As illustrated in FIG. 2, the first storage device 20 comprises a first base 21, a first peripheral wall 22 and a first positioning member 23. The first peripheral wall 22 extends upwardly from the first base 21. The first positioning member 23 is connected to the first peripheral wall 22 at a rear side thereof.

Figure 3:
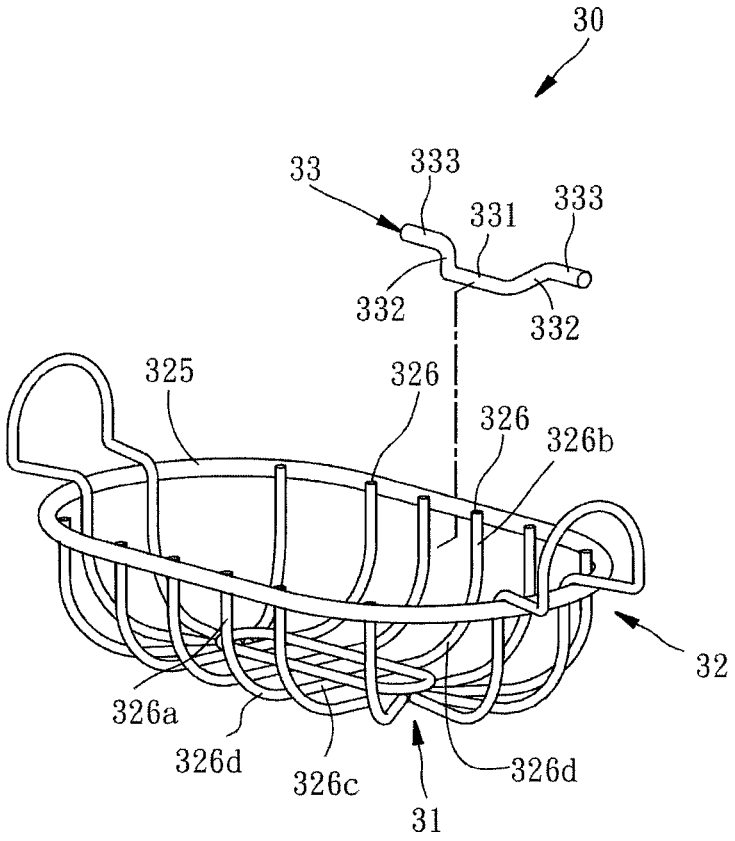
FIG. 3 is an elevational view of the second storage device of the storage combination basket assembly shown in FIG. 1.

As illustrated in FIG. 3, the second storage device 30 comprises a second base 31, a second peripheral wall 32 and a second positioning member 33. The second peripheral wall 32 extends upwardly from the second base 31, comprising a second front side and an opposing second rear side. The second positioning member 33 is connected to the second peripheral wall 32 at the second rear side thereof.

Referring to FIGS. 2 and 3 again, the first base 21, the first peripheral wall 22, the second base 31 and the second peripheral wall 32 are made of metal wires by bending. The first and second peripheral walls 22,32 each comprise a loop-shaped metal wire 225,325 and a plurality of peripheral metal wires 226,326. The peripheral metal wires 226,326 have two opposite ends thereof respectively connected to the inner perimeter of the respective loop-shaped metal wire 225,325 in a parallel manner. Each peripheral metal wire 226,326 comprises a vertical front segment 226*a*,326*a*, a vertical rear segment 226*b*,326*b* and a horizontal middle segment 226*c*,326*c*. The horizontal middle segment 226*c*, 326*c* has two opposite ends respectively upwardly curved, forming a respective arched portion 226*d*,326*d*. The vertical front segment 226*a*,326*a* and the vertical rear segment 226*b*,326*b* are respectively upwardly extended from the arched portions 226*d*,326*d* of the horizontal middle segment 226*c*,326*c*.

In this embodiment, the first base 21 is constituted by the horizontal middle segments 226*c* of the parallel arranged peripheral metal wires 226; the first peripheral wall 22 is constituted by the vertical rear segment 226*b* of the parallel arranged peripheral metal wires 226; the second base 31 is constituted by the horizontal middle segments 326*c* of the parallel arranged peripheral metal wires 326; the second peripheral wall 32 is constituted by the vertical rear segment 326*b* of the parallel arranged peripheral metal wires 326.

Further, the first and second positioning members 23,33 are respectively made by bending a respective metal wire into shape. The first and second positioning members 23,33 each comprise a horizontal extension segment 231,331, two bent segments 232,332 and two free end segments 233,333. The horizontal extension segments 231,331 are respectively connected to the vertical rear segments 226*b*,326*b* of the peripheral metal wires 226,326 of the first and second peripheral walls 22,32. The bent segments 232,332 are respectively backwardly extended from respective opposite ends of the respective horizontal extension segments 231, 331 in direction away from the respective peripheral metal wires 226,326. The free end segments 233,333 are respectively extended from the bent segments 232,332, and spaced from the respective peripheral metal wires 226,326 by a gap.

In this embodiment, the first and second storage devices 20,30 are made of metal wires. In actual application, panel and meshed materials can be selectively used for making the first and second storage devices 20,30. Further, the material for the storage devices 20,30 is not limited to metal, plastics, bamboo, wood and other materials can be selectively used as substitutes. However, in any structural design, every storage device must have the characteristics of the base, the peripheral wall and the positioning member.

Figure 4:
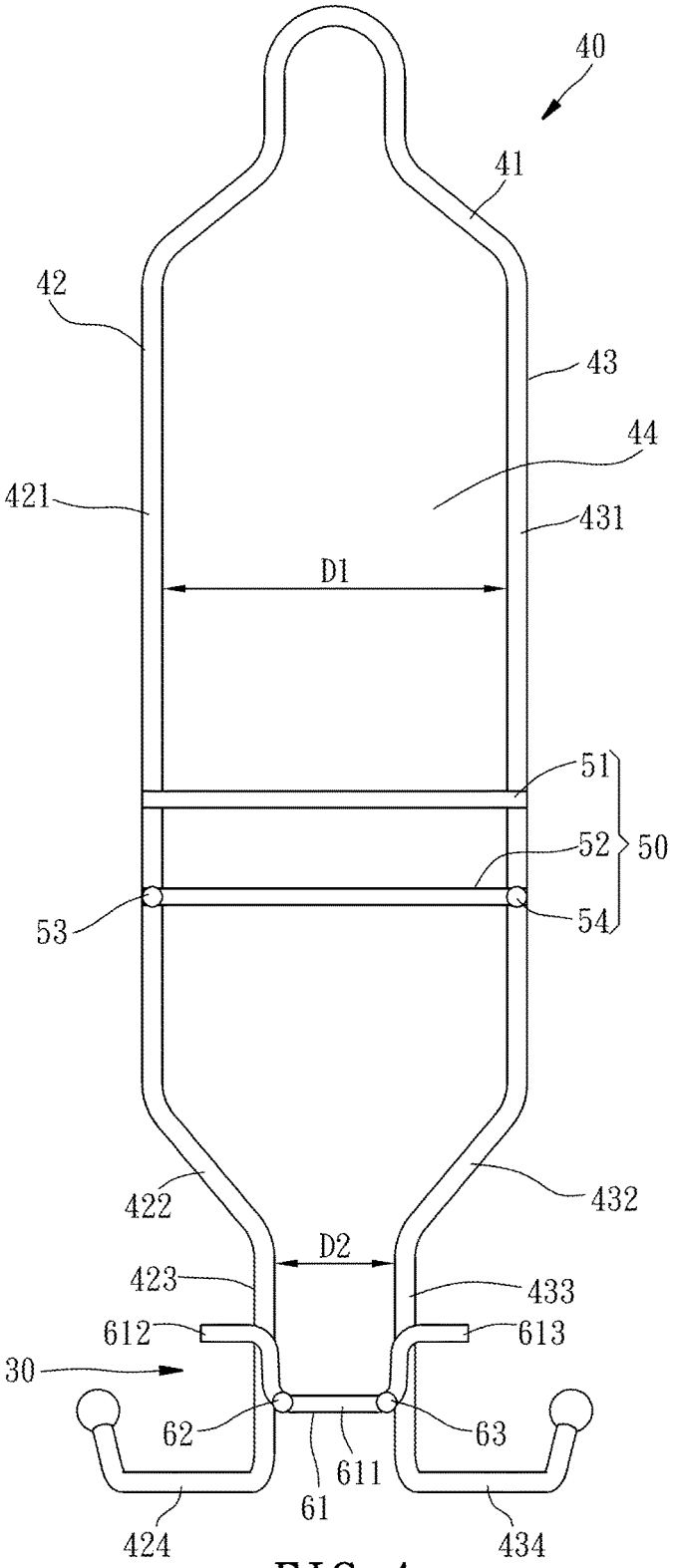
FIG. 4 is a front view of the support frame of the storage combination basket assembly shown in FIG. 1.
Figure 5:
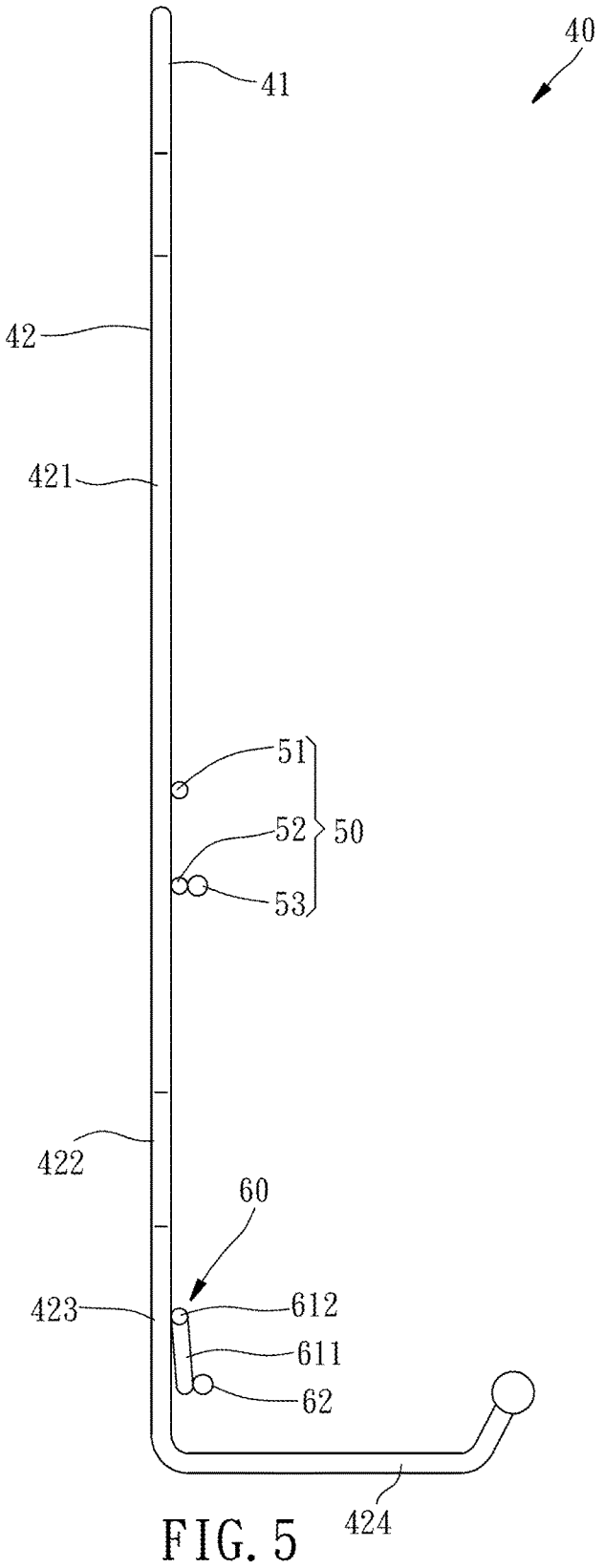
FIG. 5 is a left side view of the support frame of the storage combination basket assembly shown in FIG. 1.

Referring to FIGS. 4 and 5 in which FIG. 4 is a front view of the support frame; FIG. 5 is a left side view of the support frame. As illustrated, the support frame 40 is made of a metal wire by bending, comprising a top frame rod segment 41, a first body frame rod segment 42 and a second body frame rod segment 43. In the drawing, the top frame rod segment 41, the first body frame rod segment 42 and the second body frame rod segment 43 are divided by broken lines; actually, these broken lines do not exist. The top frame rod segment 41 has two opposite ends, as illustrated by broken lines. The first body frame rod segment 42 and the second body frame rod segment 43 are respectively downwardly extended from the two opposite ends of the top frame rod segment 41. The first and second body frame rod segments 42,43 are arranged in parallel, defining therebetween a window opening 44. The first and second body frame rod segments 42,43 each define a first straight portion 421,431, an oblique portion 422,432, a second straight portion 423,433 and a tailpiece portion 424,434. The oblique portion 422,432 extends obliquely downwardly from the first straight portion 421,431. The second straight portion 423,433 extends vertically downward from the oblique portion 422,432. The tailpiece portion 424,434 extends forwardly from the second straight portion 423,433. The oblique portions 422,432 of the first and second body frame rod segments 42,43 respectively obliquely toward an inner side of the window opening 44. The first straight portions 421,431 of the first and second body frame rod segments 42,43 define therebetween a first distance D1. The second straight portions 423,433 of the first and second body frame rod segments 42,43 define therebetween a second distance D2. The first distance D1 is greater than the second distance D2.

Further, the length of the first distance D1 is approximately equal to the length of the horizontal extension segment of the first positioning member of the first storage device, however, the length of the first distance D1 is shorter than the distance between the terminal ends of the two free end segments of the first positioning member. The length of the second distance D2 is approximately equal to the length of the horizontal extension segment of the second positioning member of the second storage device. However, the length of the second distance D2 is shorter than the distance between the terminal ends of the two free end segments of the second positioning member.

The first stopper 50 comprises an upper horizontal rod 51, a lower horizontal rod 52 and two stop blocks 53,54. The upper horizontal rod 51 has two opposite ends thereof respectively connected to the first straight portions 421,431 of the first and second body frame rod segments 42,43. The lower horizontal rod 52 has two opposite ends thereof respectively connected to the first straight portions 421,431 of the first and second body frame rod segments 42,43. The first straight portions 421,431 are disposed at a back side of the lower horizontal rod 52. The upper and lower horizontal rods 51,52 are arranged in parallel. The two stop blocks 53,54 are respectively connected to the two opposite ends of the lower horizontal rod 52 at a front side.

In this embodiment, the two stop blocks 53,54 are metal balls, having a curve surface. In actual application, the two stop blocks 53,54 can be non-spherical in shape, or partially curve-shaped; the locations of the two stop blocks 53,54 can be not at the two opposite ends of the lower horizontal rod 52.

The second stopper 60 comprises a connection rod 61 and two stop blocks 62,63. The connection rod 61 connects the second straight portions 423,433 of the first and second body frame rod segments 42,43, comprising a recessed segment 611 and two horizontal end segments 612,613. The second straight portions 423,433 are located at a back side of the connection rod 61. The two horizontal end segments 612, 613 are respectively extended from two opposite ends of the recessed segment 611, and respectively connected to the second straight portions 423,433 of the first and second body frame rod segments 42,43. The two stop blocks 62,63 are connected to the recessed segment 611 at an opposing front side of the connection rod 61, and spaced from each other at a distance. The two stop blocks 62,63 are metal balls, having a curve surface. In actual application, the two stop blocks 62,63 can be non-spherical in shape, or partially curve-shaped.

In general, the first and second stoppers 50,60 are adapted for supporting and fastening the storage devices, however, it is to be understood the stoppers of the storage combination basket assembly are not limited to the configurations described above.

After understanding of the composition and structural characteristics of the component parts of the storage combination basket assembly 10, the installation and purposes of the storage combination basket assembly are outlined hereinafter.

In installation of this embodiment, the first and second storage devices are to be inserted into the window opening of the support frame from the front side, enabling the first and second positioning members of the first and second storage devices to pass through the window opening. Thereafter, install the first and second storage devices in the respective designed positions.

Figure 6:
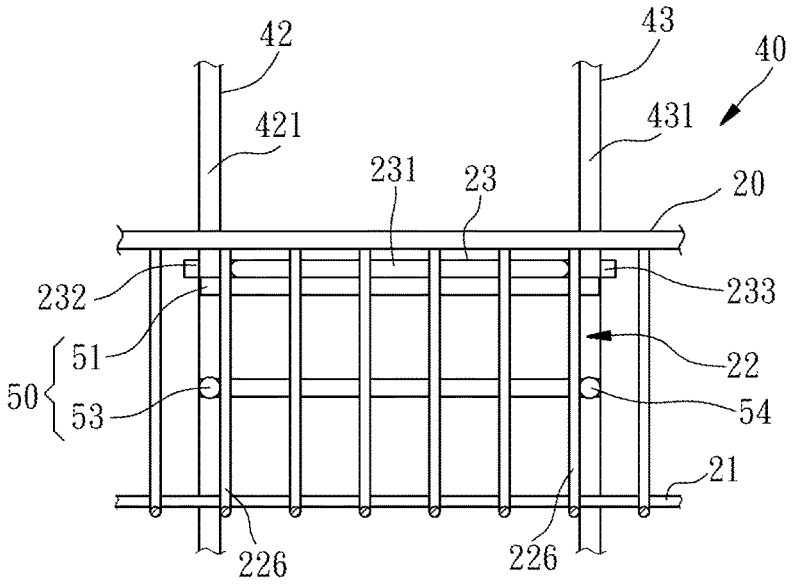
FIG. 6 is a front view of the first storage device, support frame and first stopper of the storage combination basket assembly shown in FIG. 1.
Figure 7:
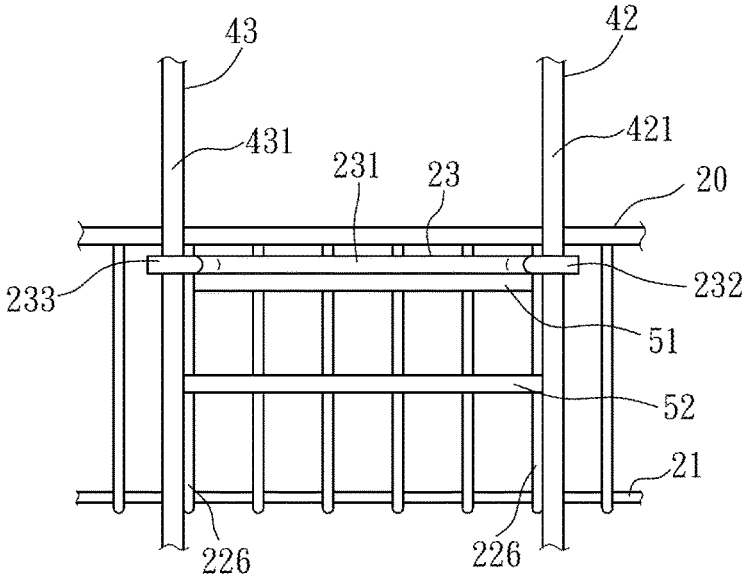
FIG. 7 is a rear side view of the first storage device, support frame and first stopper of the storage combination basket assembly shown in FIG. 1.
Figure 8:
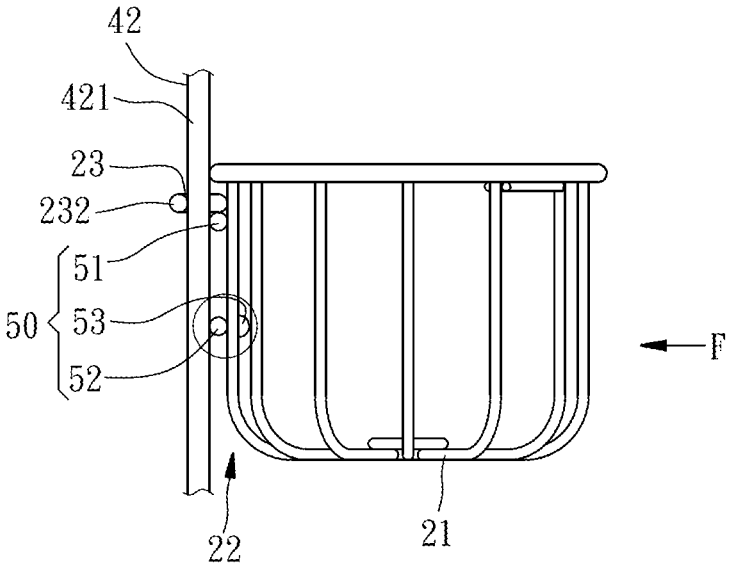
FIG. 8 is a left side view of the first storage device, support frame and first stopper of the storage combination basket assembly shown in FIG. 1.

Referring to FIGS. 6-8, these three drawings illustrate the arrangement of the first storage device 20, the first stopper 50 and a part of the support frame 40 when viewed from different angles, in which, FIG. 6 is a front view of the first storage device, support frame and first stopper of the storage combination basket assembly shown in FIG. 1; FIG. 7 is a rear side view of the first storage device, support frame and first stopper of the storage combination basket assembly shown in FIG. 1; FIG. 8 is a left side view of the first storage device, support frame and first stopper of the storage combination basket assembly shown in FIG. 1. The first storage device 20 is mounted at the support frame 40 and the first stopper 50. The base 21 and peripheral wall 22 of the first storage device 20 are disposed at a front side of the first and second body frame rod segments 42,43 of the support frame 40. The two free end segments 232,233 of the first positioning member 23 are respectively disposed at the back side of the first and second body frame rod segments 42,43 of the support frame 40, i.e., the first straight portions 421,431 of the first and second body frame rod segments 42,43 are respectively disposed in gaps in the first storage device 20. The upper horizontal rod 51 of the first stopper 50 supports the horizontal extension segment 231 of the first positioning member 23, stopping the first storage device 20 from downward displacement. The two stop blocks 53,54 of the first stopper 50 are respectively hooked on two peripheral metal wires 226 of the first storage device 20, stopping the first storage device 20 from front-back displacement.

Figure 9:
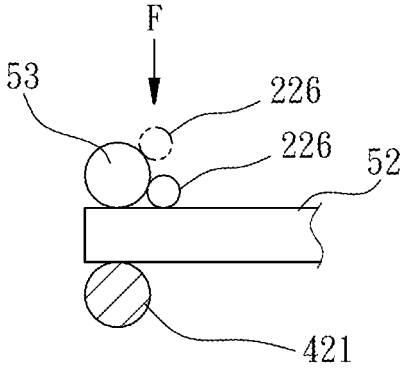
FIG. 9 is an enlarged view of a part of FIG. 8, illustrating the arrangement of the stop blocks, the peripheral metal wires and the support frame.

FIG. 9 is an enlarged bottom view of a part of FIG. 8, illustrating the arrangement of the stop blocks, the peripheral metal wires and the support frame. As illustrated, the two stop blocks 53,54 are symmetrical, having a curved surface. One stop block 53 is taken as an example for explanation. When the peripheral metal wire 226 (dashed circle) is attached to the top side of the stop block 53 prior to being pushed by a backward force F, at this time, the peripheral metal wire 226 has not yet been held in place by the stop block 53. When imparted a backward force F to the peripheral metal wire 226, the peripheral metal wire 226 is moved downwardly along the curved surface of the stop block 53 to the bottom side of the stop block 53, and then secured firmly in place, at this time, the peripheral metal wire 226 is firmly held at the bottom side of the stop block 53 in contact between the stop block 53 and the lower horizontal rod 52. On the contrary, when wishing to disengage the peripheral metal wire 226 from the stop block 53, impart a forward force to the peripheral metal wire 226 to move the peripheral metal wire 226 away from the bottom side of the stop block 53. Thus, the first storage device 20 can be easily installed in the support frame 40, and prohibited from front-back and left-right displacement.

Figure 10:
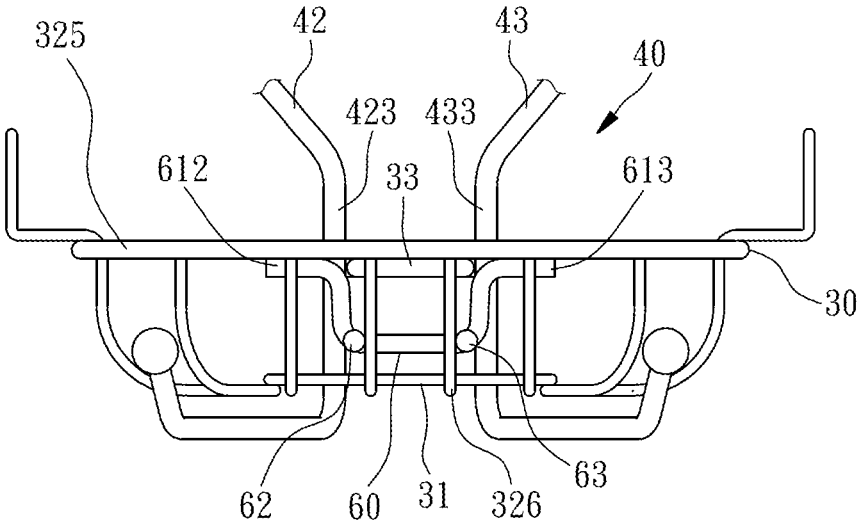
FIG. 10 is a front view of the second storage device, support frame and second stopper of the storage combination basket assembly shown in FIG. 1.
Figure 11:
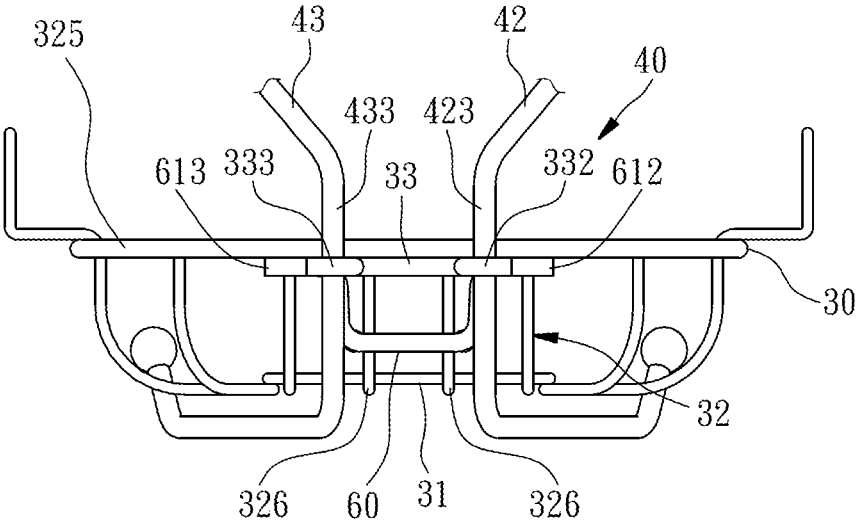
FIG. 11 is a rear side view of the second storage device, support frame and second stopper of the storage combination basket assembly shown in FIG. 1.
Figure 12:
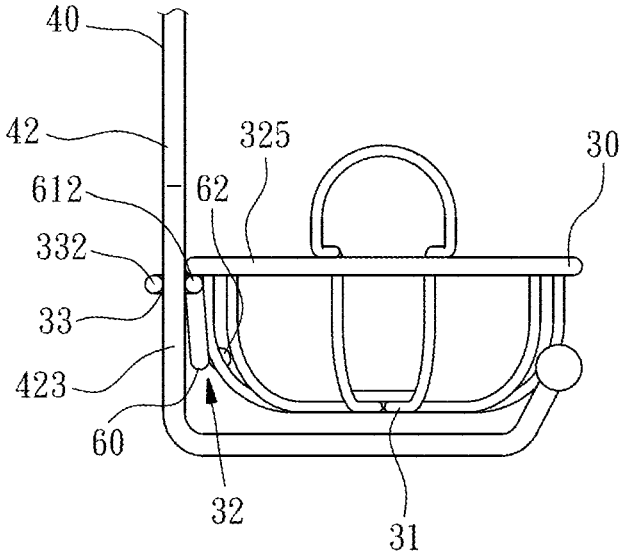
FIG. 12 is a left side view of the second storage device, support frame and second stopper of the storage combination basket assembly shown in FIG. 1.

Referring to FIGS. 10-12, these three drawings illustrate the arrangement of the f second storage device 30, the second stopper 60 and a part of the support frame 40 when viewed from different angles, in which, FIG. 10 is a front view of the second storage device, support frame and second stopper of the storage combination basket assembly shown in FIG. 1; FIG. 11 is a rear side view of the second storage device, support frame and second stopper of the storage combination basket assembly shown in FIG. 1; FIG. 12 is a left side view of the second storage device, support frame and second stopper of the storage combination basket assembly shown in FIG. 1. As illustrated, after mounting of the second storage device 30 at the support frame 40 and the second stopper 60, the base 31 and second peripheral wall 32 of the second storage device 30 are located at the front side of the first and second body frame rod segment 42,43 of the support frame 40; the two free end segments 332,333 of the second positioning member 33 are respectively located at the back side of the first and second body frame rod segment 42,43 of the support frame 40, i.e., the second straight portions 423,433 of the first and second body frame rod segment 42,43 are respectively positioned in the gaps in the second storage device 30. The two horizontal end segments 612,613 of the second stopper 60 support the loop-shaped metal wire 325 of the second storage device 30, stopping the second storage device 30 from downward displacement; the two stop blocks 62,63 of the second stopper 60 are respectively hooked on two peripheral metal wires 326 of the second peripheral wall 32 of the second storage device 30, stopping the second storage device 30 from front-back displacement.

The relationship between the two peripheral metal wires 326 of the second peripheral wall 32 of the second storage device 30 and the two stop blocks 62,63 of the second stopper 60 are same as the relationship between the first storage device 20 and the first stopper 50, and therefore, no further detailed description in this regard will be necessary.

In conclusion, the storage combination basket assembly of the invention allows the user to mount and dismount the component parts conveniently, saving packaging space and facilitating delivery. Further, the storage combination basket assembly can be configured to provide one single storage layer consisting of one or multiple storage devices, or multiple storage layers consisting of multiple storage devices. Therefore, the invention is not limited to the dual layer design of the above-described preferred embodiment.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A storage combination basket assembly, comprising:

a storage device, said storage device comprising a base, a peripheral wall and a positioning member, said peripheral wall being upwardly extended from said base, said positioning member being connected to said peripheral wall, said positioning member having two opposite ends thereof respectively spaced from said peripheral wall by a gap;

a support frame comprising a first body frame rod segment and a second body frame rod segment arranged in parallel; and a stopper connected to said first and second body frame rod segments of said support frame and adapted for supporting said storage device, said stopper comprising two stop blocks, said first and second body frame rod segments of said support frame being respectively disposed in the gaps between the two opposite ends of said positioning member and said peripheral wall, said two stop blocks of said stopper being respectively hooked in said peripheral wall of said storage device;

wherein said two stop blocks of said stopper has a curved surface; said peripheral wall of said storage device is stopped at a bottom side of said curved surface of said two stop blocks of said stopper.

2. The storage combination basket assembly as claimed in claim 1, wherein said stopper comprises an upper horizontal rod and a lower horizontal rod, said upper horizontal rod having two opposite ends thereof respectively connected to said first and second body frame rod segments of said support frame, said lower horizontal rod having two opposite ends thereof respectively connected to said first and second body frame rod segments of said support frame in a parallel manner relative to said upper horizontal rod, said two stop blocks of said stopper being respectively located at the two opposite ends of said lower horizontal rod, said upper horizontal rod being adapted for supporting said positioning member of said storage device, said lower horizontal rod being abutted against said peripheral wall of said storage device.

3. The storage combination basket assembly as claimed in claim 2, wherein said peripheral wall of said storage device comprises a loop-shaped metal wire and a plurality of peripheral metal wires, said plurality of peripheral metal wires being arranged in parallel, each said peripheral metal wire having a top side thereof connected to said loop-shaped metal wire and a bottom side thereof connected to said base of said storage device, said positioning member of said storage device being connected to said peripheral wall wires of said peripheral wall of said storage device, said two stop blocks of said stopper being respectively hooked on two peripheral metal wires of said plurality of peripheral metal wires of said peripheral wall of said storage device.

4. The storage combination basket assembly as claimed in claim 1, wherein said stopper comprises a connection rod connecting said first and second body frame rod segments of said support frame, said connection rod comprising a recessed segment and two horizontal end segments, said horizontal end segments being respectively extended from two opposite ends of said recessed segment and adapted for supporting said storage device; said two stop blocks of said stopper are respectively connected to said recessed segment.

5. The storage combination basket assembly as claimed in claim 4, wherein said peripheral wall of said storage device comprises a loop-shaped metal wire and a plurality of peripheral metal wires, said plurality of peripheral metal wires being arranged in parallel, each said peripheral metal wire each having a top side thereof connected to said loop-shaped metal wire and a bottom side thereof connected to said base of said storage device; said positioning member of said storage device is connected to said plurality of peripheral metal wires of said peripheral wall of said storage device; said two stop blocks of said stopper are respectively hooked on two peripheral metal wires of said plurality of peripheral metal wires of said peripheral wall of said storage device; said two horizontal end segments of said connection rod of said stopper support said loop-shaped metal wire of said peripheral wall of said storage device.

* * * * *